US009468306B2

(12) United States Patent
Lobry

(10) Patent No.: US 9,468,306 B2
(45) Date of Patent: Oct. 18, 2016

(54) SUPPORT DEVICE FOR A SEAT OR BED BASE

(71) Applicant: TOURNADRE SA STANDARD GUM, Bourges (FR)

(72) Inventor: Jacques Lobry, Bourges (FR)

(73) Assignee: TOURNADRE SA STANDARD GUM, Bourges (FR)

( * ) Notice: Subject to any disclaimer, the term of this patent is extended or adjusted under 35 U.S.C. 154(b) by 204 days.

(21) Appl. No.: 14/274,824

(22) Filed: May 12, 2014

(65) Prior Publication Data

US 2014/0345050 A1 Nov. 27, 2014

(30) Foreign Application Priority Data

May 13, 2013 (FR) ..... 13 54271

(51) Int. Cl.
*A47C 23/04* (2006.01)
*A47C 23/00* (2006.01)
*A47C 23/06* (2006.01)

(52) U.S. Cl.
CPC ..... *A47C 23/002* (2013.01); *A47C 23/06* (2013.01)

(58) Field of Classification Search
CPC ..... A47C 23/04; A47C 23/06
USPC ..... 5/236.1, 239, 246–247
See application file for complete search history.

(56) References Cited

U.S. PATENT DOCUMENTS 2,313,171 A * 3/1943 Piliero ..... A47C 23/30 5/247

FOREIGN PATENT DOCUMENTS

| | | |
|---|---|---|
| EP | 2220968 B1 | 8/2010 |
| FR | 2793125 A1 | 10/2000 |
| FR | 2914164 A1 | 3/2008 |

* cited by examiner

*Primary Examiner* — Fredrick Conley
(74) *Attorney, Agent, or Firm* — MH2 Technology Law Group, LLP

(57) ABSTRACT

A support device designed to extend between two long sides of a bed base frame or of a seat base frame so as to support a mattress. Implementations of the device may include a lower section comprising at least one elongate crosspiece suitable for being fastened to respective ones of the two long sides of the frame, an upper section comprising a platform suitable for supporting the mattress, and an intermediate section resiliently interconnecting the lower section and the upper section via a plurality of resilient members that are disposed along the crosspiece. In various implementations, the longitudinal spacing between the two first resilient members that are closest to the first end of the crosspiece is greater than the longitudinal spacing between the two first resilient members that are closest to the middle of the crosspiece.

22 Claims, 14 Drawing Sheets

SUPPORT DEVICE FOR A SEAT OR BED BASE

CROSS-REFERENCE TO RELATED APPLICATIONS

This application claims priority to French Patent Application No. 1354271 filed May 13, 2013.

FIELD OF THE INVENTION

The present specification relates to the field of mattress support devices, and in particular to support devices that are designed to extend between two long sides of a frame of a bed base or of a seat base (e.g. for sofas or armchairs) so as to support the mattress.

STATE OF THE PRIOR ART

It is already known that said devices can conventionally be made up of slats fastened via their ends to two long sides of the frame of a bed base or of a seat base. Such slats support the mattress directly, over the entire width thereof, thereby making it possible to provide continuity for supporting the user in the width direction of the frame.

However, such slatted devices suffer from the drawback of sagging and dipping significantly in the central portion of the slats under the weight of the user, when said user is lying down in said central portion. This results in a lack of comfort for the user who, once lying down in the central portion of the slats, is confined within the central portion that forms a trough-shaped dip.

To mitigate that problem, it is known that the slats can be replaced with blocks or studs that support the mattress at respective points. Unfortunately, relative to slatted devices, such point bearing surfaces suffer from the drawback of causing discontinuity in the support of the user across the width of the frame. That discontinuity can adversely affect the impression of comfort given by that type of suspension device, in particular when the user turns over and moves in the width direction of the frame.

Therefore, there exists a need to develop a support device that is capable of attenuating the dipping of conventional slatted devices while also preserving a certain amount of continuity in the support for the mattress in the width direction of the frame.

PRESENTATION OF THE INVENTION

A first aspect of the present specification provides a support device designed to extend between two long sides of a bed base frame or of a seat base frame so as to support a mattress, said device comprising: a lower section comprising at least one elongate crosspiece having two longitudinal ends suitable for being fastened to respective ones of the two long sides of the frame, and a middle equidistant from the two ends;

an upper section comprising a platform suitable for supporting the mattress; and an intermediate section resiliently interconnecting the lower section and the upper section via a plurality of resilient members that are disposed along the crosspiece;

wherein said plurality comprises at least three first resilient members, each of which is disposed between a first one of the two ends and the middle of the crosspiece; and the longitudinal spacing between the two first resilient members that are closest to the first end is greater than the longitudinal spacing between the two first resilient members that are closest to the middle of the crosspiece.

Thus, in a first half of the crosspiece, which is defined between a first one of its two ends and its middle, at least three first resilient members are disposed (it being specified that the middle is an integral part of said first half of the crosspiece, so that one of said at least three first resilient members may, selectively, be placed at the exact location of the middle of the crosspiece or be set back from said middle, towards the first end of the crosspiece).

The longitudinal spacing between the two first resilient members (from among these at least three first resilient members disposed between the first end and the middle of the crosspiece) that are closest to the first end of the crosspiece is arranged to be greater than the longitudinal spacing between the two first resilient members (from among these three first resilient members disposed between the first end and the middle of the crosspiece).

This difference in longitudinal spacing results in a densification of the number of resilient members, going away from the first end towards the middle of the crosspiece.

This density of resilient members, in the central portion of the device, may be used advantageously to limit the dipping of the platform under the weight of the user, and to do so even more effectively since this density is specially reinforced in said central portion, relative to the vicinity of the first end of the crosspiece, where the density of resilient members is lower.

In addition, the longitudinal dimensions of the platform that is resiliently supported by the resilient members, may be appropriately chosen in such a manner as to procure a certain amount of continuity in the support for the mattress in the width direction of the frame.

In the present specification, the terms "longitudinal" or "longitudinally" are used to designate the main direction of elongate extension of the elongate crosspiece, i.e. the longitudinal direction of said elongate crosspiece. This longitudinal direction also corresponds to the direction in which the two long sides of the frame are spaced apart, when the device is fastened to the frame (this direction thus extends in the width direction of the frame, when the two long sides actually form the two longer sides of the frame). This direction also corresponds to the main direction of elongate extension of the support device as a whole.

In addition, in the present specification, the term "vertical" is used to designate the direction that is vertical when the device is fastened to the frame. This vertical direction also corresponds to the direction in which the upper and lower sections of the device are spaced apart.

In addition, in the present specification, the term "horizontal plane" is used to designate a plane that is horizontal when the device is fastened to the frame. This plane is therefore perpendicular to the above-mentioned vertical direction. This plane also contains the above-mentioned longitudinal direction.

In addition, in the present specification, the terms "transverse" or "transversely" designate a direction contained in the horizontal plane and perpendicular to the main direction of elongate extension of the elongate crosspiece. This direction is thus a direction that is transverse relative to the longitudinal direction of said elongate crosspiece. This transverse direction is also perpendicular to the spacing direction in which the two long sides of the frame are spaced apart when the device is fastened to the frame. In addition, this transverse direction also corresponds to the direction of elongate extension of the two long sides (this direction thus extends in the direction of the length of the frame, when the two long sides actually form the two longer sides of the frame).

In certain embodiments, the longitudinal spacing between the two first resilient members that are closest to the first end may be at least 1.3 times greater than the longitudinal spacing between the two first resilient members that are closest to the middle of the crosspiece.

This lower limit of 1.3 corresponds to a threshold below which it has been observed that the dipping of the central portion of the device under the weight of the user is less effectively limited by the support from the resilient members, which are not significantly denser in the vicinity of the central portion relative to the vicinity of the first end of the crosspiece.

In addition, it may be desired to manufacture the device via a limited number of manufacturing steps in such a manner as to simplify the manufacturing method and as to reduce the manufacturing cost.

Thus, in certain embodiments, the first resilient members may be made of a same material, e.g. of the same plastics material.

In addition, in certain embodiments, the first resilient members may be of identical shape.

In certain embodiments, said plurality may comprise at least three second resilient members, each of which extends between the second of the two ends and the middle of the crosspiece, and the longitudinal spacing between the two resilient members that are closest to the second end may be greater than the longitudinal spacing between the two resilient members that are closest to the middle of the crosspiece.

Thus, in a second half of the crosspiece, which is defined between the second one of its two ends and its middle, at least three second resilient members may be disposed (it being specified that the middle is an integral part of said second half of the crosspiece, so that one of said at least three second resilient members may, selectively, be placed at the exact location of the middle of the crosspiece or be set back from said middle, on the same side as the second end of the crosspiece).

The longitudinal spacing between the two second resilient members (from among these at least three second resilient members disposed between the second end and the middle of the crosspiece) that are closest to the second end of the crosspiece may be arranged to be greater than the longitudinal spacing between the two second resilient members (from among these at least three second resilient members disposed between the second end and the middle of the crosspiece).

It is thus possible to obtain the same advantages over the second half of the crosspiece as the advantages mentioned above for the first half of the crosspiece.

In certain embodiments, at least one of the sections from among the lower section, the intermediate section, and the upper section of the device (i.e., selectively a single one, each of only two, or each one of said sections) may have a transverse plane of symmetry relative to the crosspiece, thereby making it possible to allow the method of manufacturing the device to be simplified.

The expression "transverse plane of symmetry" is used to designate a plane of symmetry that is perpendicular to the longitudinal direction (it is therefore a vertical plane, perpendicular to the spacing direction in which the two long sides of the frame are spaced apart when the device is fastened to the frame).

Thus, when at least one of said sections is symmetrical about such a plane of symmetry, it can be understood that said at least one section has characteristics on either side of said plane that are mutually symmetrical about said plane.

In certain embodiments, the device may be such that the plane of symmetry passes through the middle of the crosspiece.

In certain embodiments, the device may, in addition, be such that each of the lower, intermediate, and upper sections is symmetrical about the plane of symmetry.

In certain embodiments, the platform may be formed integrally in one piece, thereby making it possible to procure optimum continuity for the support for the mattress in the width direction of the frame.

In certain embodiments, the platform may be longitudinally dissociated into a plurality of distinct segments.

The platform may thus be split up into a plurality of distinct segments in the direction of the length (of the main direction of elongate extension) of the crosspiece, the platform being formed by fastening said segments to the intermediate portion of the device.

By splitting up the platform into at least two distinct segments, to be positioned one after the other in the direction of the length of the crosspiece, it is possible to mount said segments on any type of frame, regardless of the spacing distance at which the two long sides of the frame in question are spaced apart. It thus becomes possible to make segments that are standard so that they are adapted to be mounted on various different frame models with the long sides being spaced apart at different spacing distances.

In certain embodiments, a first of said segments may longitudinally interconnect at least two resilient members from among said at least three first resilient members.

By providing a segment that is sufficiently long in the longitudinal direction to interconnect at least two resilient members, it is possible to procure better continuity in the support for the mattress along said longitudinal direction.

In certain embodiments, the first one of said segments may longitudinally interconnect at least the two first resilient members that are closest to the first end.

In certain embodiments, relative to the first resilient members to which the first one of said segments is connected, said first segment may project longitudinally to a larger extent on the side closer to the first end of the crosspiece than on the side closer to the middle of the crosspiece.

This characteristic may make it possible for the first segment to project sufficiently on the side closer to the first end to cover at least in part the first of the two long sides to which the first end of the crosspiece is fastened. As a result, improved comfort and/or improved overall aesthetic appearance can be procured for the device.

In addition, this characteristic may thus allow the first segment to project to as short an extent as desired in the longitudinal direction and relative to the first resilient members to which said first segment is connected. It is thus possible to provide longitudinal spacing between the first segment and the following segment directly adjacent to it that is as small as possible, thereby making it possible to limit the discontinuity of support for the mattress on going from one segment to the other.

In certain embodiments, a second of said segments may be connected at least to that one of the three first resilient members that is closest to the middle of the crosspiece.

This solution may be implemented when the first segment is too short, in the longitudinal direction, to be fastened to all of the resilient members situated in the first half of the crosspiece, those members being referred to as the "first resilient members". This configuration may occur when the spacing distance at which the two long sides of the frame are spaced apart is particularly large relative to the dimensions of the first segment, that, for example, it has been desired to "standardize" for all frame models, regardless of the dimensions thereof. The presence of this second segment can then come to compensate for the void generated by the first segment being too short.

In this example, the platform may have at least one contact zone that is designed to come into contact with the mattress, and that has relief for minimizing the contact with the mattress.

Such relief may thus include at least a higher portion, on which the mattress can come to bear, and a lower portion, designed to remain at some distance from the mattress, when said mattress is bearing against the higher portion, so as to procure improved flow of air around the mattress.

In certain embodiments, the relief may be made up of a longitudinal succession of undulations.

Such relief may thus be such that, in the longitudinal direction, high portions and low portions alternate in succession so as to form a succession of undulations. This solution makes it possible to optimize both the continuity of the support for the mattress and the flow of air all the way along the longitudinal direction of the device.

In certain embodiments, the relief may, transversely, be made up of a plurality of longitudinal successions of undulations that are longitudinally offset relative to one another.

Such relief can thus be such that, over a first portion, in the transverse direction, the platform has at least a first longitudinal succession of undulations, and, over a second portion adjacent to the first portion in the transverse direction, has a second longitudinal succession of undulations having its extrema offset, in the longitudinal direction, relative to the extrema of the first succession of undulations.

This solution makes it possible to optimize both the continuity of the support for the mattress and the flow of air both in the longitudinal direction and in the transverse direction of the device.

In certain embodiments, each of the longitudinal successions of undulations may have the same spatial period and be longitudinally offset relative to one another by one half of said spatial period.

Such relief can thus be such that the minima of the undulations of the first succession coincide, in the longitudinal direction, with the maxima of the undulations of the second succession.

Such a configuration may optimize further the continuity of the support and the flow of air by maximizing the densification in terms of numbers of alternations of high and of low portions both in the longitudinal direction and in the transverse direction of the device.

In certain embodiments, the relief may, transversely, be made up of at least three longitudinal successions of undulations that are longitudinally offset relative to one another by one half of the spatial period.

Such relief may also be such that the maxima and/or the minima of the undulations of said three longitudinal successions are arranged in staggered manner in the "horizontal" plane that is formed by the longitudinal and transverse directions of the device.

In addition, in this example, the platform may be provided with recesses forming thin zones in which the thickness of the material is thinner, and that allow the platform to have local reductions in stiffness.

This configuration can make it possible to optimize the local deformations of the platform in order to accommodate better the particular positioning of the user on the mattress, while also preserving good overall continuity of the support for the mattress.

In certain embodiments, the recesses may be formed between the undulations in such manner that the undulations are interconnected by the thin zones, thereby making it possible to optimize all of the above-mentioned parameters simultaneously.

In certain embodiments, the device may include at least one strap that passes through the recesses so as to project alternately below and above the platform.

Such a projecting strap mounted in this way on the platform can thus make it possible to alternate between the first portions of the strap that project from the top surface of the platform (and that can thus come into contact with the mattress, when said mattress comes to bear against the platform), and the second portions of the strap that project from the bottom surface of the platform (and that are therefore not visible from the top surface of the platform).

This configuration can make it possible to improve the overall aesthetic appearance of the platform as seen from its top surface, which can alternate between bare material of the platform and textile material of the strap.

In addition, this configuration can allow the mattress to adhere better, when said mattress comes to bear against the platform, at the places where the first portions made of a textile material are situated.

Furthermore, this configuration can make it possible to adjust the overall and/or local resilience of the platform as a function of the degree of tension in the strap relative to the platform.

In certain embodiments, the device may include at least one resilient body mounted to move on at least one of the resilient members so as to allow the stiffness of said resilient member to be modified.

A second aspect of the present specification provides an assembly comprising: a bed base frame or a seat base frame that is provided with two long sides; and a plurality of support devices as defined in the above-mentioned first aspect, all of which extend between the two long sides in mutually parallel manner, in order to support a mattress.

The above-mentioned characteristics and advantages, as well as others, appear more clearly on reading the following detailed description of embodiments that are in no way limiting, and that are proposed merely by way of illustration. This detailed description is given with reference to the accompanying drawings.

BRIEF DESCRIPTION OF THE DRAWINGS

The accompanying drawings are diagrammatic and are not to scale; their main aim is to illustrate the principles mentioned in the present specification. In the accompanying drawings.

DETAILED DESCRIPTION OF EMBODIMENTS

Figure 1:
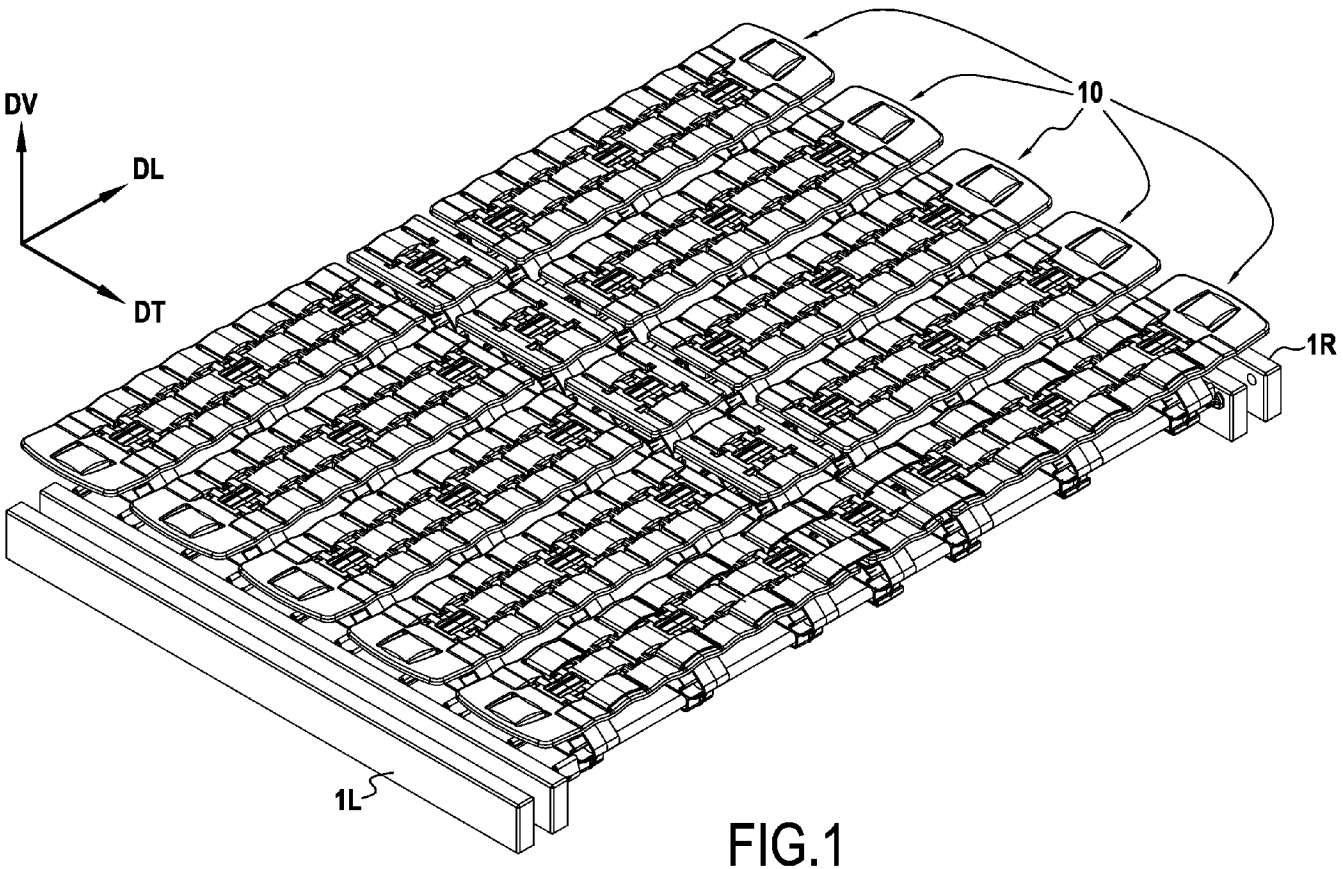
FIG. 1 is a fragmentary perspective view of an assembly comprising a bed base frame and a plurality of support devices as described in the present specification.

FIG. 1 is a perspective view of an assembly as described in the present specification.

In FIG. 1, the assembly comprises: a bed base frame provided with two long sides 1L and 1R; and a plurality of support devices 10, each of which extends between the two long sides 1L and 1R, said support devices extending parallel to one another for the purpose of supporting a mattress (not shown in the drawings).

However, without going beyond the ambit of the present specification, it is possible to provide a seat base frame rather than a bed base frame.

Each of the support devices 10 has a main direction of elongate extension referred to as the "longitudinal direction" DL. In other words, each of these devices 10 is generally elongate in said longitudinal direction DL.

This longitudinal direction DL corresponds to the spacing direction in which the two long sides 1L and 1R are spaced apart when the devices 10 are fastened to the frame of the bed base.

The devices 10 are disposed on the frame in such a manner as to be spaced apart from one another in a spacing direction referred to as the "transverse direction" DT.

This transverse direction DT is perpendicular to the longitudinal direction DL, in a horizontal plane, when the devices 10 are fastened to the frame.

This horizontal plane is therefore defined by the transverse direction DT and by the longitudinal direction DL. It is perpendicular to a "vertical direction" DV.

In this example, the support devices 10 are mutually identical, so that only one of these devices is described in more detail, in order to make the present specification concise.

Figure 2:
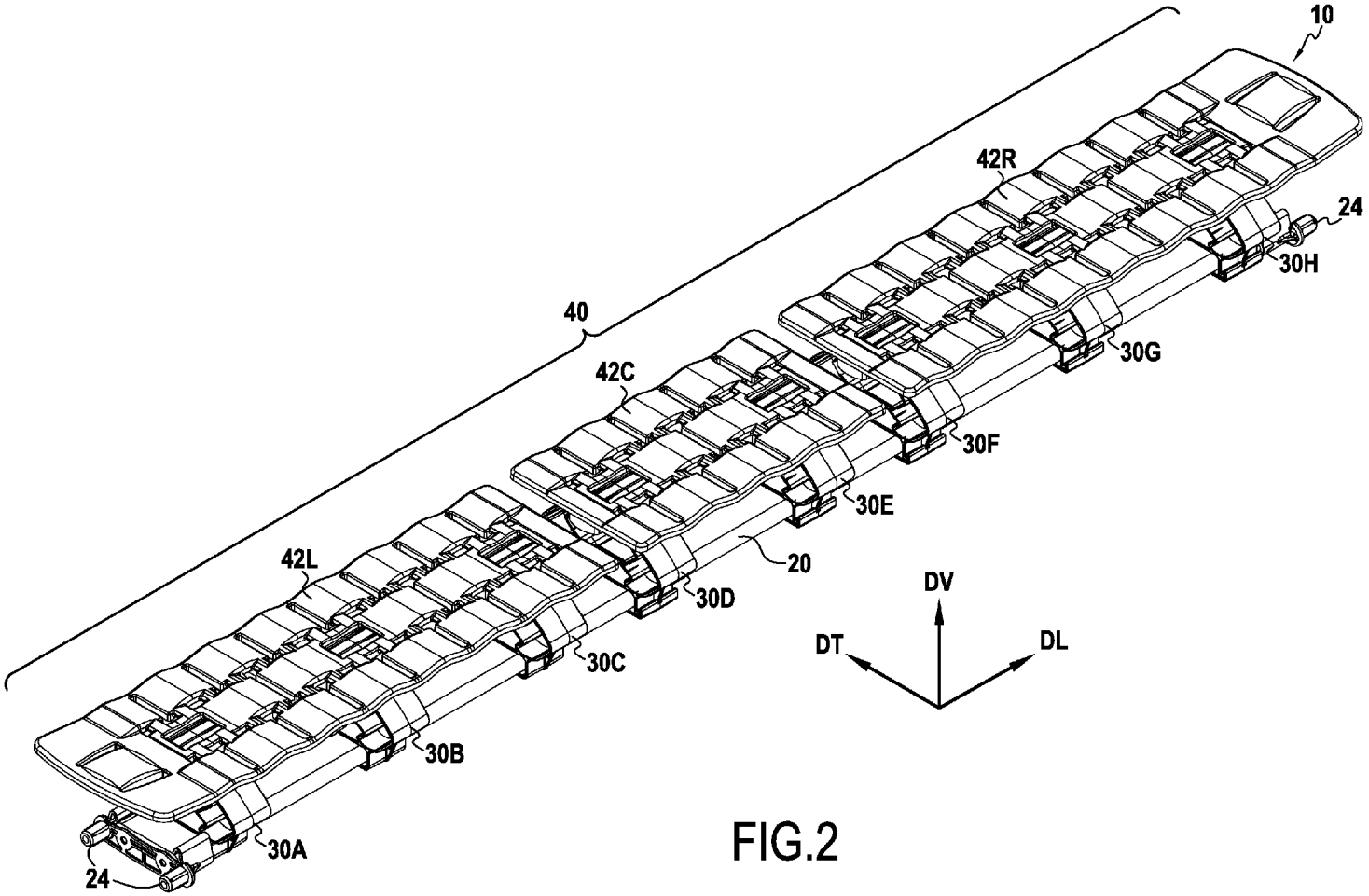
FIG. 2 is a perspective view of an embodiment of a support device shown in isolation.
Figure 3:
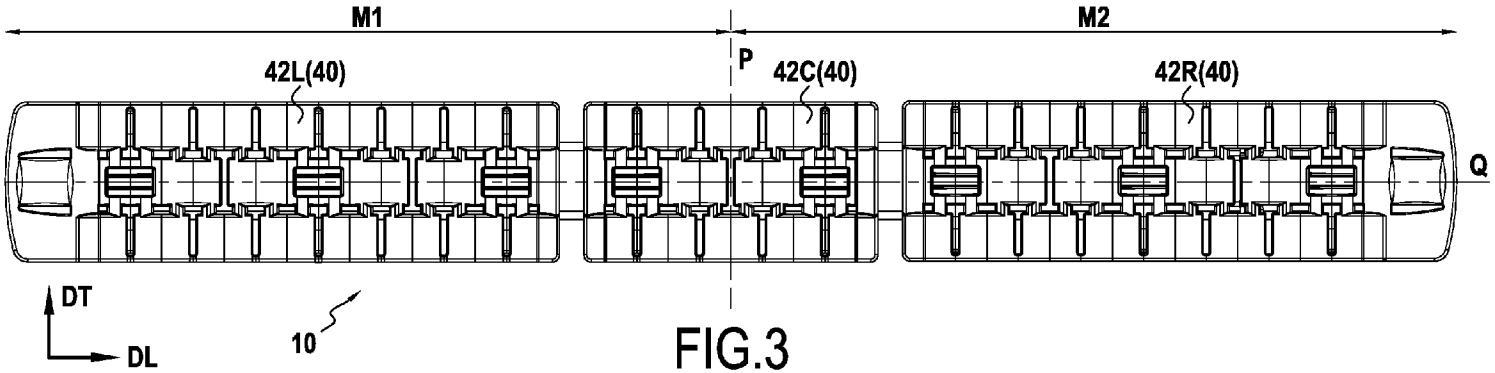
FIG. 3 is a plan view of the device as shown in FIG. 2.
Figure 4:
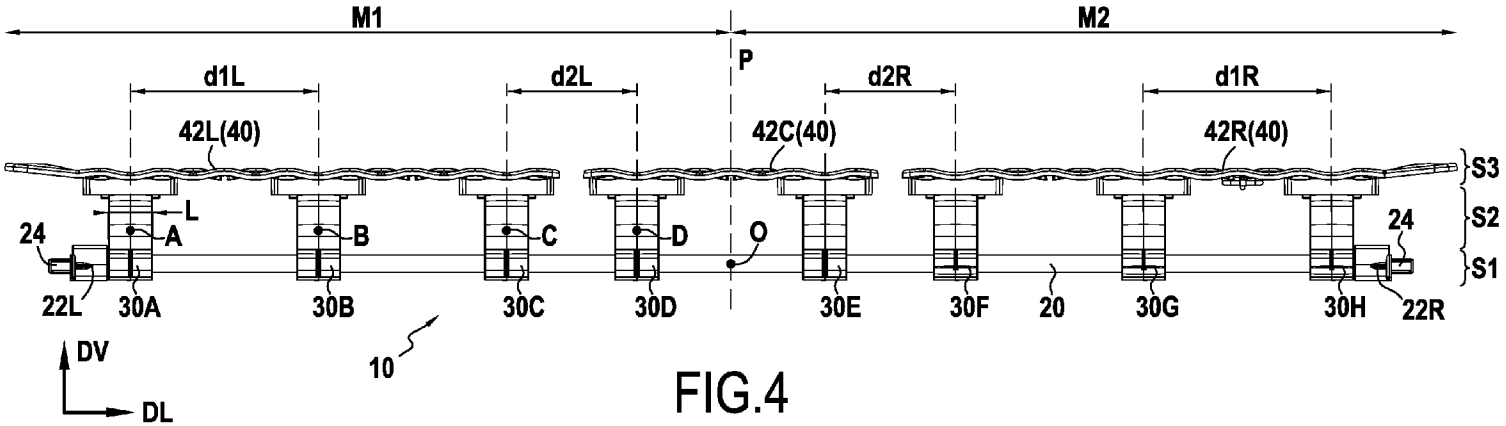
FIG. 4 is a side view, in a longitudinal plane, showing the device as shown in FIG. 2.

As shown in FIGS. 2 to 4, in particular, the support device 10 is made up of a lower section S1, of an intermediate section S2, and of an upper section S3, these sections succeeding one another in the vertical direction DV, going upwards.

The lower section S1 comprises an elongate, rigid crosspiece 20 that is designed to extend between the two long sides 1L, 1R of the frame.

However, it is possible, without going beyond the ambit of the present specification, to provide a lower section comprising at least two crosspieces, in particular at least two crosspieces spaced apart in the transverse direction DT.

The crosspiece 20 has a main direction of elongate extension corresponding to the longitudinal direction DL of the device 10.

The crosspiece 20 comprises, in succession, in the longitudinal direction DL: a first end 22L suitable for being fastened to a first one (1L) of the two long sides of the frame; a middle O; and a second end 22R suitable for being fastened to the second one (1R) of the two long sides of the frame.

The middle O of the crosspiece is, by definition, situated equidistant from the two ends 22L and 22R of the crosspiece 20, in the longitudinal direction DL.

The two ends 22L and 22R of the crosspiece 20 may be fastened to respective ones of the two long sides 1L and 1R of the frame via any suitable fastening means that are known per se, e.g. one or more peg(s) 24.

The upper section S3 comprises a platform 40 suitable for supporting the mattress.

The intermediate section S2 resiliently interconnects the lower section S1 and the upper section S3 by means of a plurality of resilient members 30A-30H that are disposed along the crosspiece 20.

In this example, the resilient members 30A-30H are:

(1) dissociated from one another;

(2) dissociated from the platform 40;

(3) dissociated from the crosspiece 20;

(4) made of the same material, e.g. of a plastics material having elasticity properties adapted to suit the present use; and (5) mutually identical (so that only one of the resilient members is described in detail, with concern to make the present specification concise).

However, it is possible, without going beyond the ambit of the present specification, to provide resilient members that do not have at least one of the above-mentioned characteristics (1) to (5).

Figure 9:
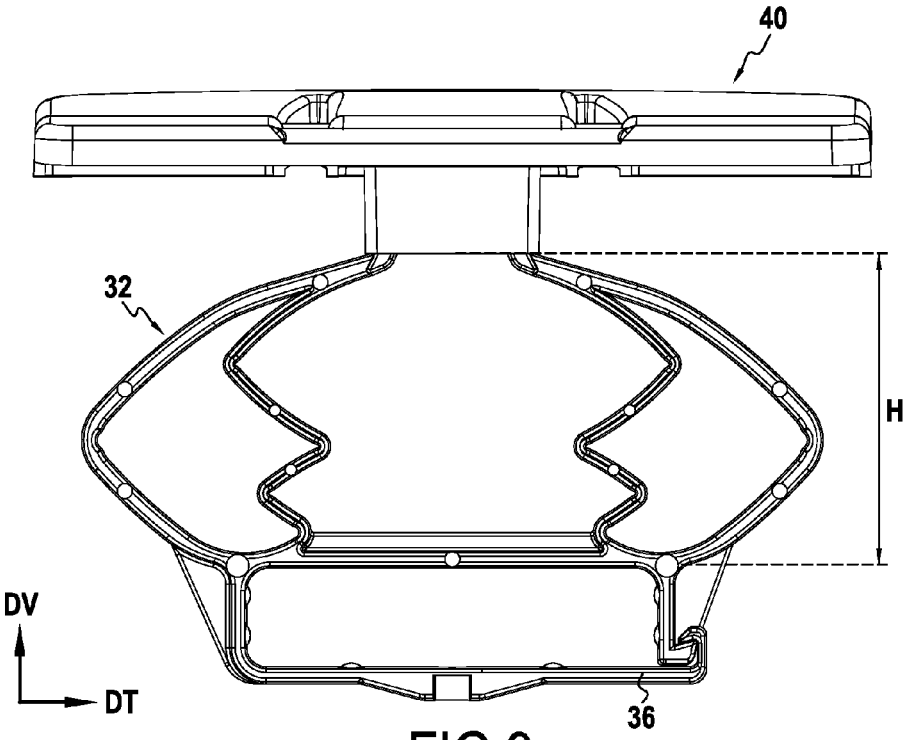
FIG. 9 is a view analogous to FIG. 8, but seen from the side, in a transverse plane of the device.
Figure 10:
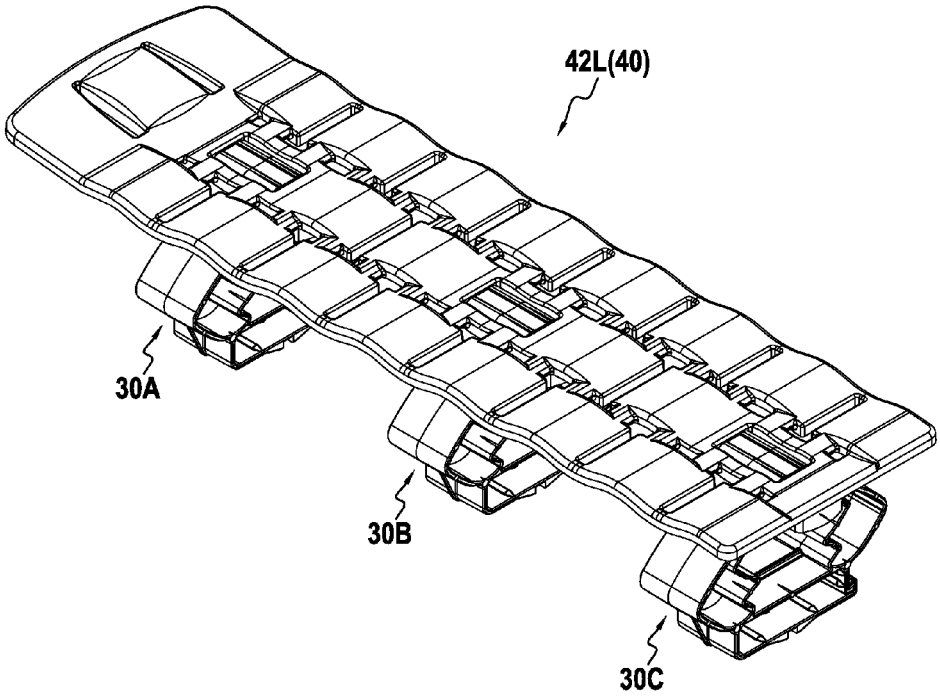
FIG. 10 is a perspective view of the first platform segment as assembled to several resilient members.
Figure 11:
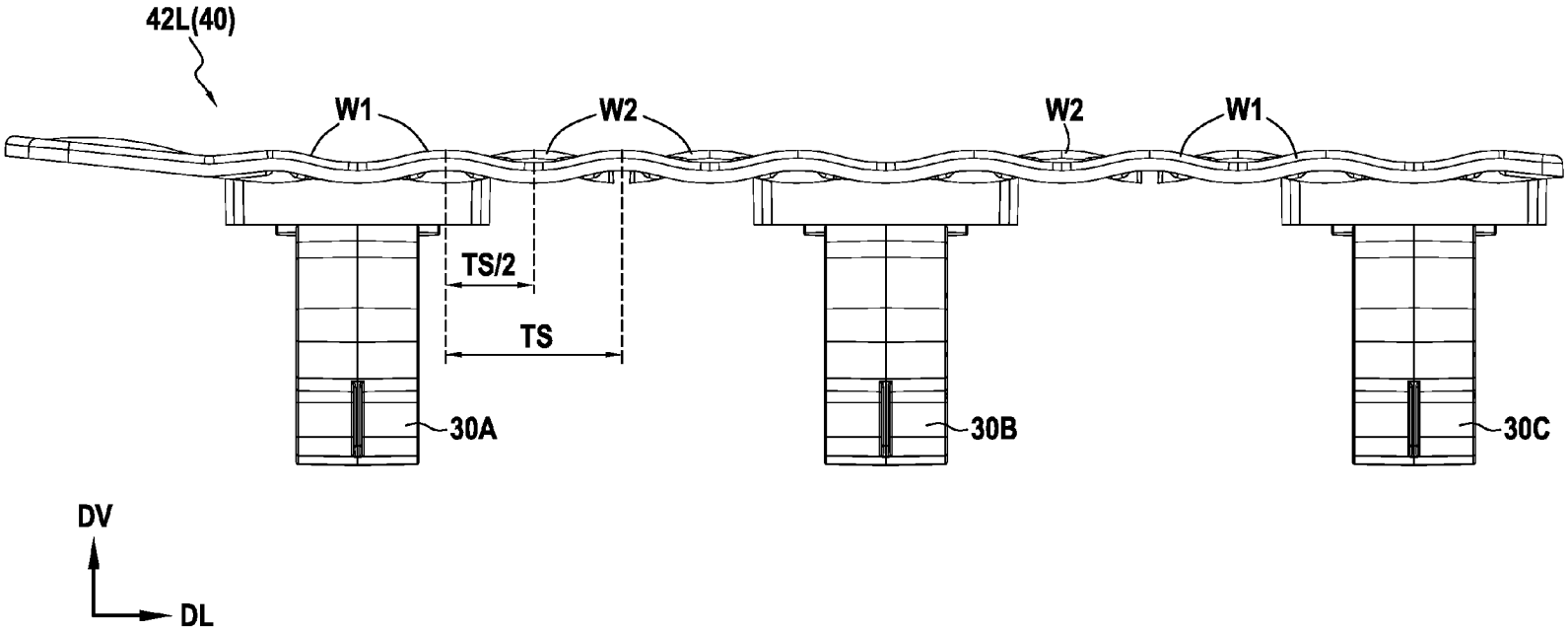
FIG. 11 is a view analogous to FIG. 10, but seen from the side, in a longitudinal plane of the device.

As shown in FIG. 9, over a predetermined height H in the vertical direction, each resilient member has an elastically deformable portion 32 that is elastically deformable in the vertical direction DV and that is suitable for deforming elastically to enable the lower section S1 and the upper section S3 to move towards each other in the vertical direction DV, when pressure is exerted on the upper section S3, and to enable said sections S1 and S3 to move apart from each other when the device 10 returns to rest, after such pressure ceases to be exerted.

In this example, and in a manner well known per se, the elastically deformable portion 32 is made up of a plurality of arcuate portions arranged in such a manner as to enable the portion 32 to deform elastically.

As shown in FIG. 4, the elastically deformable portion 32 has a predetermined width L in the longitudinal direction DL, which width is adapted to enable desired stiffness to be obtained for the portion 32.

In addition, in this example, over a first longitudinal half M1 defined between the first end 22L and the middle O of the crosspiece 20, the device 10 includes four resilient members that, in FIG. 4 and in the order in which they appear going from the first end 22L towards the middle O, are referenced 30A, 30B, 30C, and 30D. Since these four resilient members 30A to 30D are disposed over the first half M1, they are referred to below as "first" resilient members.

However, without going beyond the ambit of the present specification, it is possible to provide a device that, over this first half M1, has another number of resilient members, so long as it has at least three over this half M1.

In this example, the longitudinal spacing d1L between the two first resilient members that are closest to the first end 22L (in FIG. 4, these members are members 30A and 30B) is greater than the longitudinal spacing d2L between the two resilient members that are closest to the middle O (in the figure, these members are members 30C and 30D).

As shown in FIG. 4, a method of determining the spacing d1L and the spacing d2L consists in calculating: for spacing d1L: the distance between a point A that is situated in the middle of the width L of the elastically deformable portion 32 of the resilient member 30A in the longitudinal direction DL, and a point B that is situated in the middle of the width L of the elastically deformable portion 32 of the resilient member 30B in the longitudinal direction DL; and for spacing d2L: the distance between a point C that is situated in the middle of the width L of the elastically deformable portion 32 of the resilient member 30C in the longitudinal direction DL, and a point D that is situated in the middle of the width L of the elastically deformable portion 32 of the resilient member 30D in the longitudinal direction DL.

In this example, the longitudinal spacing d1L between the two first resilient members 30A and 30B that are closest to the first end 22L is at least 1.3 times (and in particular at least 1.4 times) greater than the longitudinal spacing d2L between the two first resilient members 30C and 30D that are closest to the middle O of the crosspiece 20.

In this example, the longitudinal spacing d1L between the two first resilient members 30A and 30B that are closest to the first end 22L is at least 2.0 times (and in particular at least 1.6 times) greater than the longitudinal spacing d2L between the two first resilient members 30C and 30D that are closest to the middle O of the crosspiece 20.

In addition, in this example, over a second longitudinal half M2 defined between the second end 22R and the middle O of the crosspiece 20, the device 10 includes four resilient members that, in FIG. 4 and in the order in which they appear going from the middle O towards the second end 22R, are referenced 30E, 30F, 30G, and 30H. Since these four resilient members 30E to 30H are disposed over the second half M2, they are referred to below as "second" resilient members.

However, without going beyond the ambit of the present specification, it is possible to provide a device that, over this second half M2, has another number of resilient members.

In this example, the longitudinal spacing d1R between the two second resilient members that are closest to the second end 22R (in FIG. 4, these members are members 30G and 30H) is greater than the longitudinal spacing d2R between the two resilient members that are closest to the middle O (in the figure, these members are members 30E and 30F).

A method of determining the spacing d1R and the spacing d2R is, in this example, identical to the method described above relating to the spacing d1L and d2L.

In addition, in this example, the device 10 has a plane of symmetry P that is transverse relative to the crosspiece 20. Thus, the plane of symmetry P is perpendicular to the longitudinal direction DL (see FIGS. 2 to 4).

In this example, the plane of symmetry P contains the middle O of the crosspiece 20.

In this example, each of the sections, namely the lower section S1, the intermediate section S2, and the upper section S3 are symmetrical about the plane of symmetry P.

However, it is possible, without going beyond the ambit of the present specification, to provide a device in which only one or two of the sections from among the lower, intermediate, and upper sections is or are symmetrical about a plane of symmetry that is perpendicular to the longitudinal direction.

In this example:

(6) the spacing d1R is equal to the spacing d1L;

(7) the spacing d2R is equal to the spacing d2L; and (8) the number of second resilient members along the same half M2 is equal to the number of first resilient members along the second half M1 of the crosspiece 20.

However, it is possible, without going beyond the ambit of the present specification, to provide a device that does not have at least one of the above-mentioned characteristics (6) to (8).

In addition, in this example, the device 10 has a plane of symmetry Q defined by the vertical direction DV and by the longitudinal direction DL. This plane of symmetry Q is thus perpendicular to the plane of symmetry P and perpendicular to the transverse direction DT.

In addition, in this example, the platform 40 is, in the longitudinal direction, dissociated into a plurality of distinct segments (i.e. segments that are dissociated from one another) in particular three distinct segments 42L, 42C, and 42R, as shown in FIG. 3.

However, it is possible, without going beyond the ambit of the present specification, to provide a platform that is formed integrally in one piece.

In this example, a first one (42L) of said segments interconnects, in the longitudinal direction DL, at least two resilient members from among the first resilient members 30A to 30D.

In particular, in this example, the first segment 42L interconnects, in the longitudinal direction DL, at least the two first resilient members that are closest to the first end 22L of the crosspiece 20.

In particular, in this example, the first segment 42L interconnects, in the longitudinal direction DL, the three first resilient members 30A, 30B, and 30C that are closest to the first end 22R of the crosspiece 20.

In this example, in the longitudinal direction and relative to the first resilient members 30A to 30C, this first segment 42L projects to a larger extent on the side closer to the first end 22L of the crosspiece 20 than on the side closer to the middle O of the crosspiece 20 (see, in particular, FIG. 4).

In this example, another one (42R) of said segments interconnects, in the longitudinal direction DL, at least two resilient members from among the first resilient members 30E to 30H.

In particular, in this example, this segment 42R interconnects, in the longitudinal direction DL, at least the two second resilient members that are closest to the second end 22R of the crosspiece 20.

Even more particularly, this segment 42R interconnects, in the longitudinal direction DL, the three second resilient members 30F, 30G, and 30H that are closest to the second end 22R of the crosspiece 20.

In this example, each of the segments 42L and 42R interconnects three resilient members, but it is possible to depart from this characteristic without going beyond the ambit of the present specification.

In this example, the segments 42L and 42R are mutually identical, but it is possible to depart from this characteristic without going beyond the ambit of the present specification.

In this example, another one (42C) of said segments is connected at least to that one of the first resilient members that is closest to the middle O of the crosspiece 20 (in particular, that resilient member is the resilient member 30D).

In particular, in this example, this segment 42C is also connected, in the longitudinal direction DL, to a second resilient member, in particular to that one of the second resilient members that is closest to the middle O of the crosspiece 20 (in particular, that resilient member is the resilient member 30E).

However, it is possible, without going beyond the ambit of the present specification, to provide a segment 42C connected to only one of or to more than two of the resilient members (see, for example, the variants described below in the present specification).

In this example, the platform 20 has at least one contact zone that is designed to come into contact with the mattress, and that has relief for minimizing the contact with the mattress.

In particular, in this example, said relief is formed on the top surface of each of the segments 42L, 42C, and 42R, but it is possible to depart from this characteristic without going beyond the ambit of the present specification.

In addition, in this example, the platform 40 is provided with recesses 46 forming thin zones 48 in which the thickness of the material is thinner, and that allow the platform 40 to have local reductions in stiffness.

In this example, said recesses 46 are formed on each of the segments 42L, 42C, and 42R, but it is possible to depart from this characteristic without going beyond the ambit of the present specification.

In this example, the characteristics of the segment 42C are analogous to the characteristics of the first segment 42L. In addition, as indicated above, in this example, the segments 42L and 42R are mutually identical. Therefore, only the first segment is described in more detail, with concern to make the present specification more concise.

In this example, the relief formed on the top surface 44 of the first segment 42L has at least one longitudinal succession of undulations W1 to W3 (i.e. a succession of undulations that succeed one another in the longitudinal direction DL).

In particular, in this example, in the transverse direction DT, the relief is made up of a plurality of longitudinal successions of waves W1 to W3 that are longitudinally offset relative to one another, and in particular three such successions, but it is possible to depart from this number of successions without going beyond the ambit of the present specification.

Figure 5:
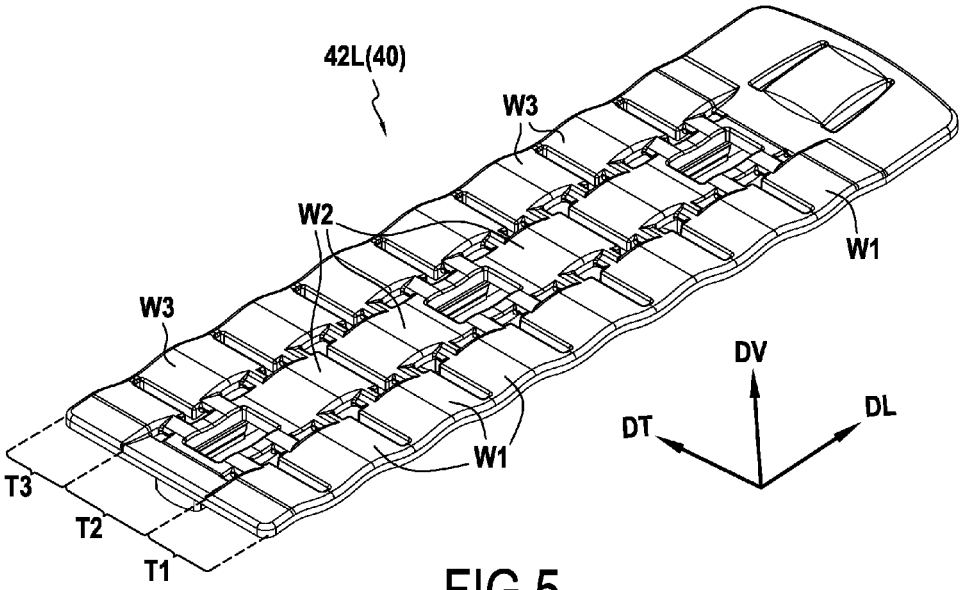
FIG. 5 is a perspective view of a first platform segment of a device as shown in FIG. 2.
Figure 6:
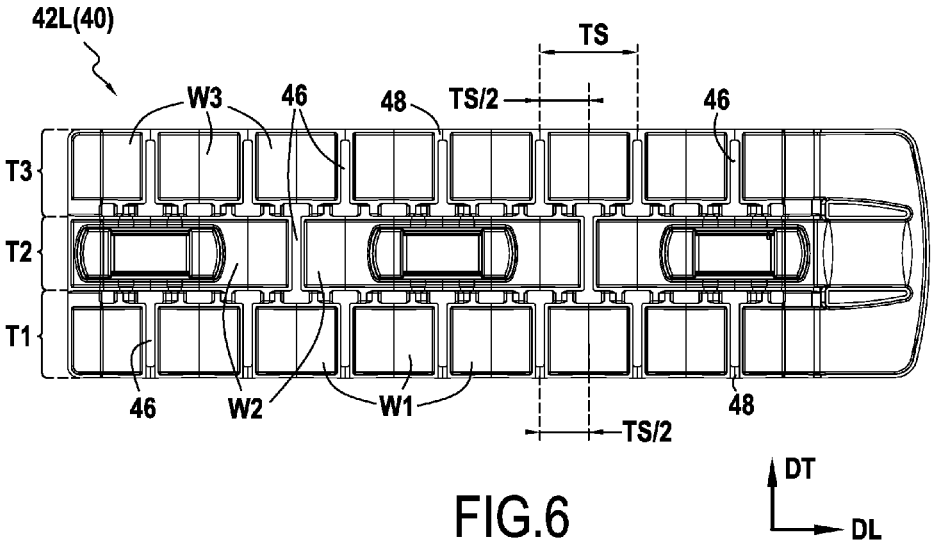
FIG. 6 is a plan view of the first segment as shown in FIG. 5.

Thus, in this example, the relief is such that it has:

over a first portion T1, in the transverse direction DT, the first longitudinal succession of undulations W1;

over a second portion T2, adjacent to the first portion T1 in the transverse direction DT, the second longitudinal succession of undulations W2; and over a third portion T3, adjacent to the second portion T2 in the transverse direction DT, on the side further from the first portion T1, the third longitudinal succession of undulations W3 (see, in particular, FIGS. 5 and 6).

In this example, each of the longitudinal successions of undulations W1 to W3 has the same spatial period TS and they are offset from one another in the longitudinal direction DL by one half of said spatial period TS.

This configuration makes it possible for maxima and minima of the undulations to be arranged in staggered manner in the horizontal plane defined by the longitudinal direction DL and by the transverse direction DT. However, it is possible to depart from this configuration without going beyond the ambit of the present specification.

In addition, in this example, the recesses 46 are formed between the undulations in such a manner that the undulations are interconnected by thin zones 48 in which the thickness of material is thinner.

In particular, in this example, the recesses 46 are formed in troughs that are formed by the portions of the undulations that are lower in the vertical direction DV. In this example, the thin zones 48 correspond to the portions of material that remain in the troughs that are recessed in this way.

In addition, in this example, recesses 46 form notches that are elongate in a main direction of elongate extension that is parallel to the transverse direction DT.

In addition, as indicated above, in this example, the resilient members 30A-30H are dissociated from the platform 40; and the resilient members 30A-30H are configured to be assembled and fastened (secured) to the platform 40.

Figure 7:
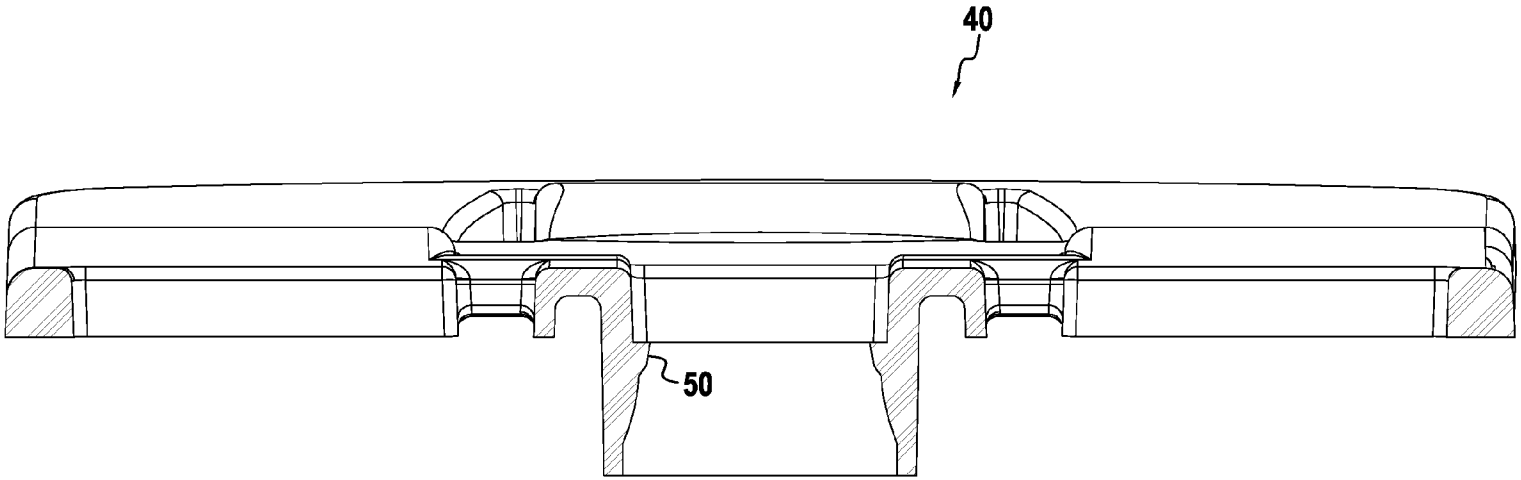
FIG. 7 is a cross-section view of the first segment as shown in FIG. 5, said cross-section being taken on a transverse plane and at the portion for fastening the first segment to one of the resilient members of the device as shown in FIG. 2.

For this purpose, in this example (see, in particular FIGS. 7 and 8), each of the resilient members 30A-30H includes at least one first fastening portion 34, and the platform 40 (in particular each of the segments 42L, 42C, and 42R) includes a plurality of second fastening portions 50, each of which is suitable for co-operating with first fastening portions 34 for assembling and fastening the resilient members 30A-30H to the platform 40.

In this example, the first and second fastening portions are configured to co-operate mutually by a clipping effect for assembling and fastening the resilient members 30A-30H to the platform 40.

In addition, as indicated above, in this example, the resilient members 30A-30H are dissociated from the crosspiece 20, and the resilient members 30A-30H are configured to be assembled and fastened (secured) to the crosspiece 20.

For this purpose, in this example, each of the resilient members 30A-30H includes a third fastening portion 36 or 36', and the crosspiece 20 includes a plurality of fourth fastening portions 52, each of which is suitable for co-operating with one of the third fastening portions 36 or 36' to assemble and fasten the resilient members 30A-30H to the crosspiece 20.

In this example, the third and fourth fastening portions are configured to co-operate mutually using any effect that is well known per se in the field of bed base or seat base frames.

Figure 8:
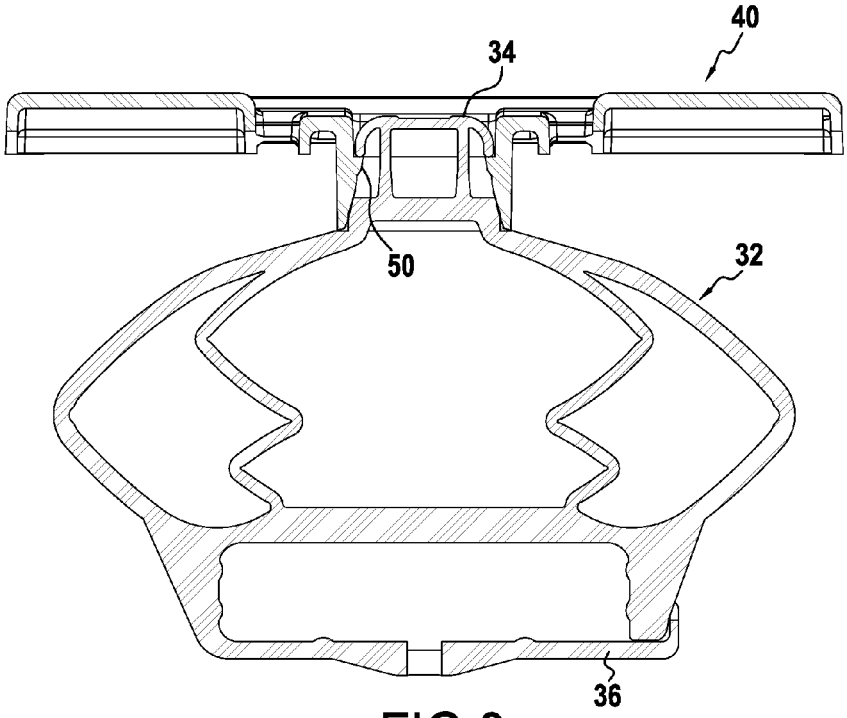
FIG. 8 is a cross-section view analogous to FIG. 7, but with the first segment and said one of the resilient members as assembled together.

For example, the third fastening portions 36 may form encircling portions configured in a manner that is well known per se to encircle the crosspiece 20 so as to assemble and so as to fasten the resilient members 30A-30H to the crosspiece 20 (see, in particular, FIGS. 4, 8, and 9). In this situation, the periphery of the crosspiece 20 may form directly the above-mentioned fourth fastening portions.

Figure 17:
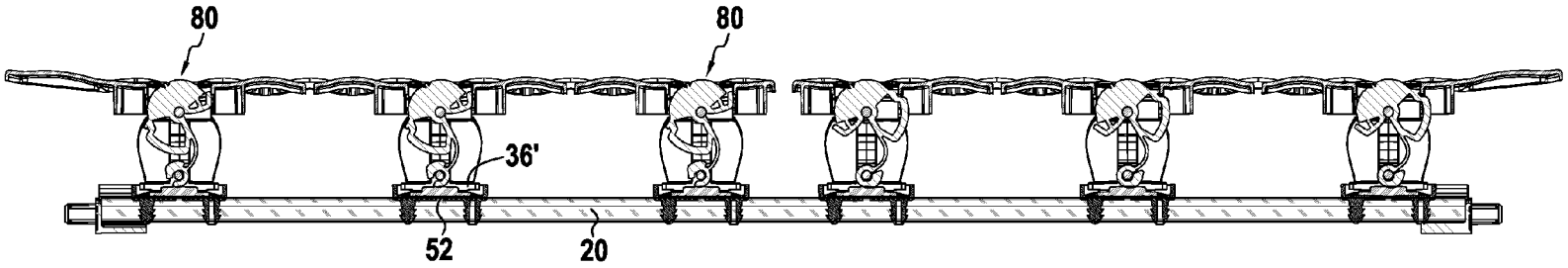
FIG. 17 is a section view in a longitudinal plane of the device shown in FIG. 16, which shows the resilient bodies mounted to move in the resilient members to allow the stiffness of said resilient members to be modified.

In another example, the third fastening portions 36' and the fourth fastening portions 52 may be configured in a manner that is well known per se so as to engage with one another and so as to lock mutually in position by turning (in particular through one quarter of a turn) in order to assemble and in order fasten the resilient members 30A-30H to the crosspiece 20 (see, in particular, FIG. 17).

Variants of the above-mentioned example are described below. Only the characteristics given in detail below differ from this example. Conversely, all the other characteristics not recalled below remain unchanged relative to this embodiment; they are not described in detail again, in order to make the present specification concise.

First Variant:

In the above-mentioned embodiment, it is chosen to mount eight resilient members on the crosspiece (four in the first half M1 of the crosspiece 20, all set back from the middle O of the crosspiece 20 on the same side as its first end 22L, and four others in its second half M2, all set back from the middle O of the crosspiece 20 on the same side as its second end 22L; see, in particular FIG. 4).

In addition, in the above-mentioned example, it is chosen to split the platform 40 into three segments 42L, 42C, and 42R. The segment 42L is connected to the three resilient members that are closest to the first end 22L of the crosspiece 20. The segment 42R is connected to the three resilient members that are closest to the second end 22R of the crosspiece 20. The central segment 42C is connected to the two resilient members that are closest to the middle O of the crosspiece 20 (see, in particular FIG. 13B).

Figure 12A:
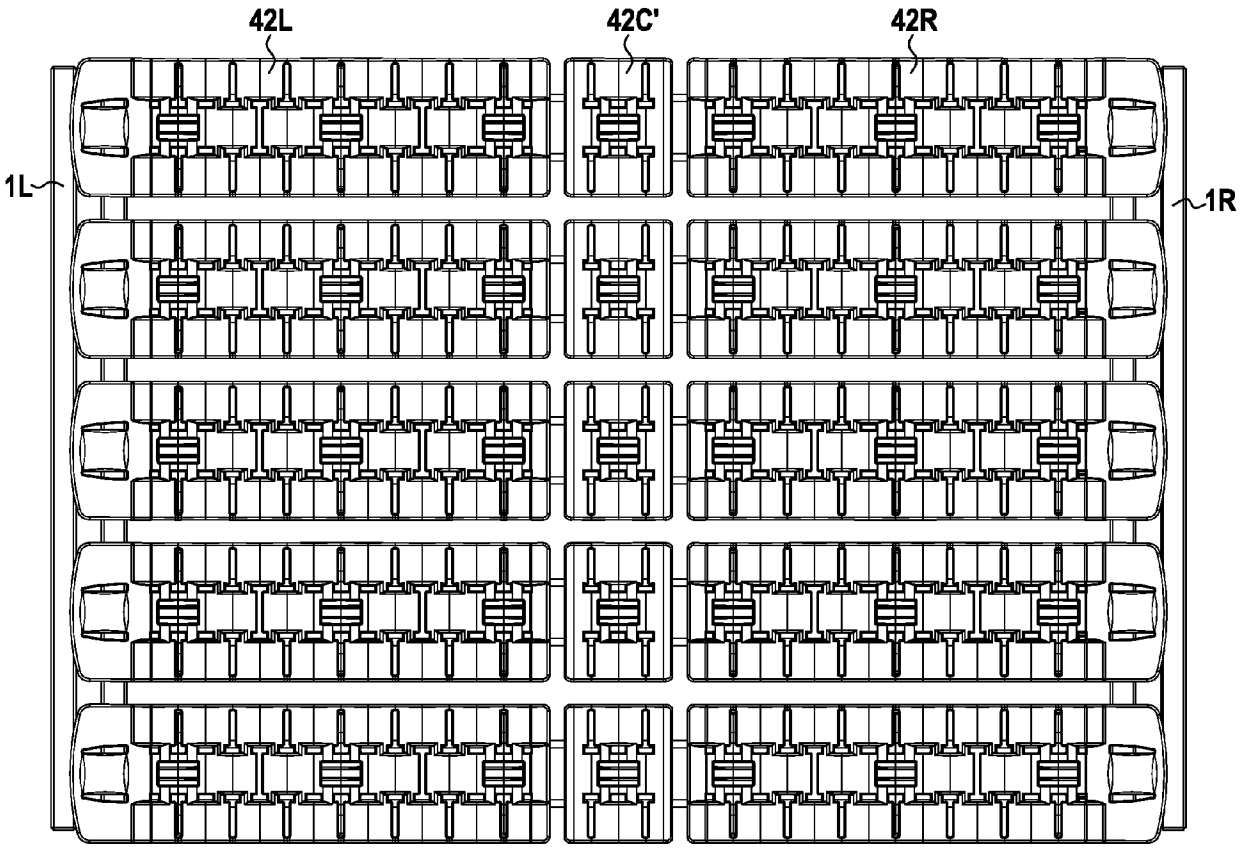
FIG. 12A is a plan view of a first variant of the device shown in FIG. 2.

Conversely, in the first variant described below (see, in particular FIGS. 1 and 12A), it is chosen to mount only seven resilient members on the crosspiece 20 (three in the first half M1 of the crosspiece 20, all set back from the middle O of the crosspiece 20 on the same side as its second end 22L; three others in its second half M2, all set back from the middle O of the crosspiece 20 on the same side as its second end 22L; and a last one disposed in the middle O of the crosspiece; this last resilient member thus belongs both to the family of the first resilient members and to the family of the second resilient members).

In addition, in this first variant, it is chosen to split up the platform 40 into three segments 42L, 42C', and 42R. The segment 42L is connected to the three resilient members that are closest to the first end 22L of the crosspiece 20. The segment 42R is connected to the three resilient members that are closest to the second end 22R of the crosspiece 20. The central segment 42C' is connected only to the resilient member that is disposed in the middle O of the crosspiece 20 (see, in particular FIG. 13A).

The choice of varying the number of resilient members along the crosspiece and of varying the arrangement of the segments of the platform may be used advantageously, but non-limitingly, when the spacing distance by which the long sides 1L and 1R of the frame are spaced apart varies from one model to another.

Figure 12B:
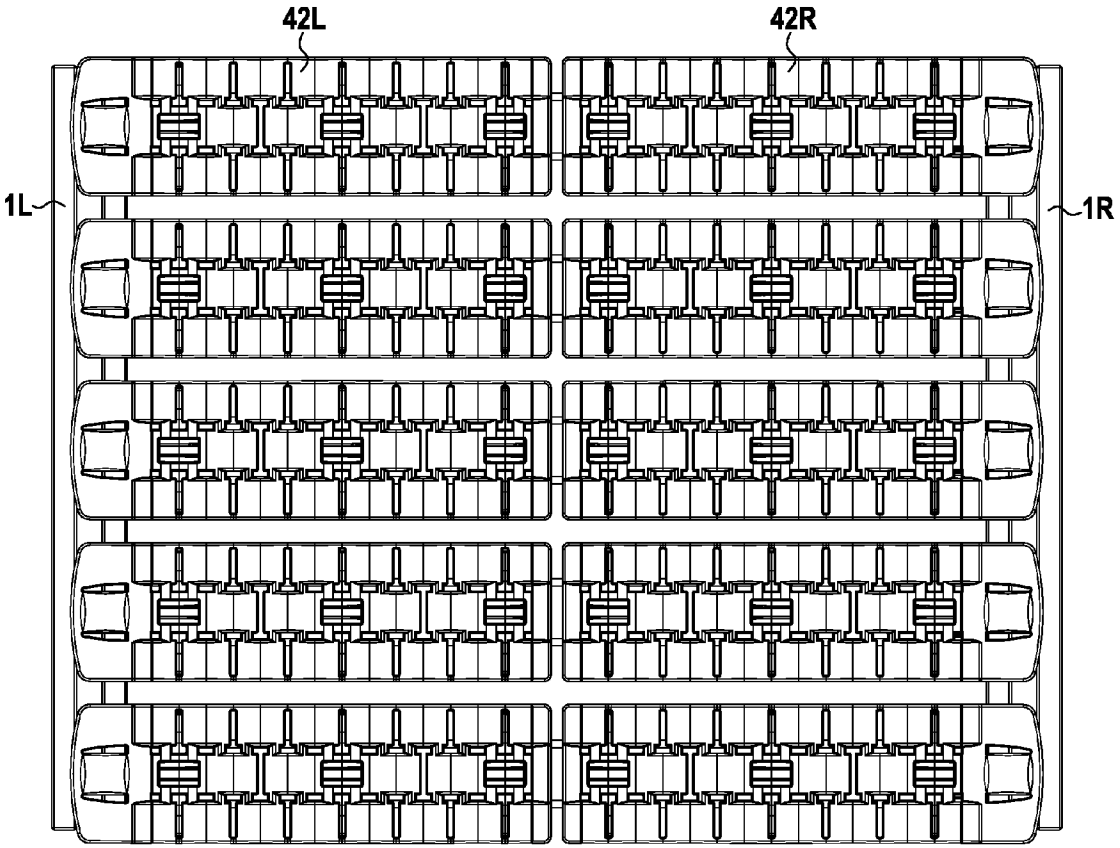
FIG. 12B is a view analogous to the FIG. 12A view, but showing a second variant embodiment of a device.

Second Variant:

Similarly, in the second variant described below (see, in particular, FIG. 12B), it is chosen to mount only six resilient members on the crosspiece 20 (three in the first half M1 of the crosspiece 20, all set back from the middle O of the crosspiece 20 on the same side as its first end 22L, and three others in its second half M2, all set back from the middle O of the crosspiece 20 on the same side as its second end 22L).

In addition, in this first variant, it is chosen to split up the platform 40 into only two segments 42L and 42R. The segment 42L is connected to the three resilient members that are closest to the first end 22L of the crosspiece 20. The segment 42R is connected to the three resilient members that are closest to the second end 22R of the crosspiece 20.

Figure 12C:
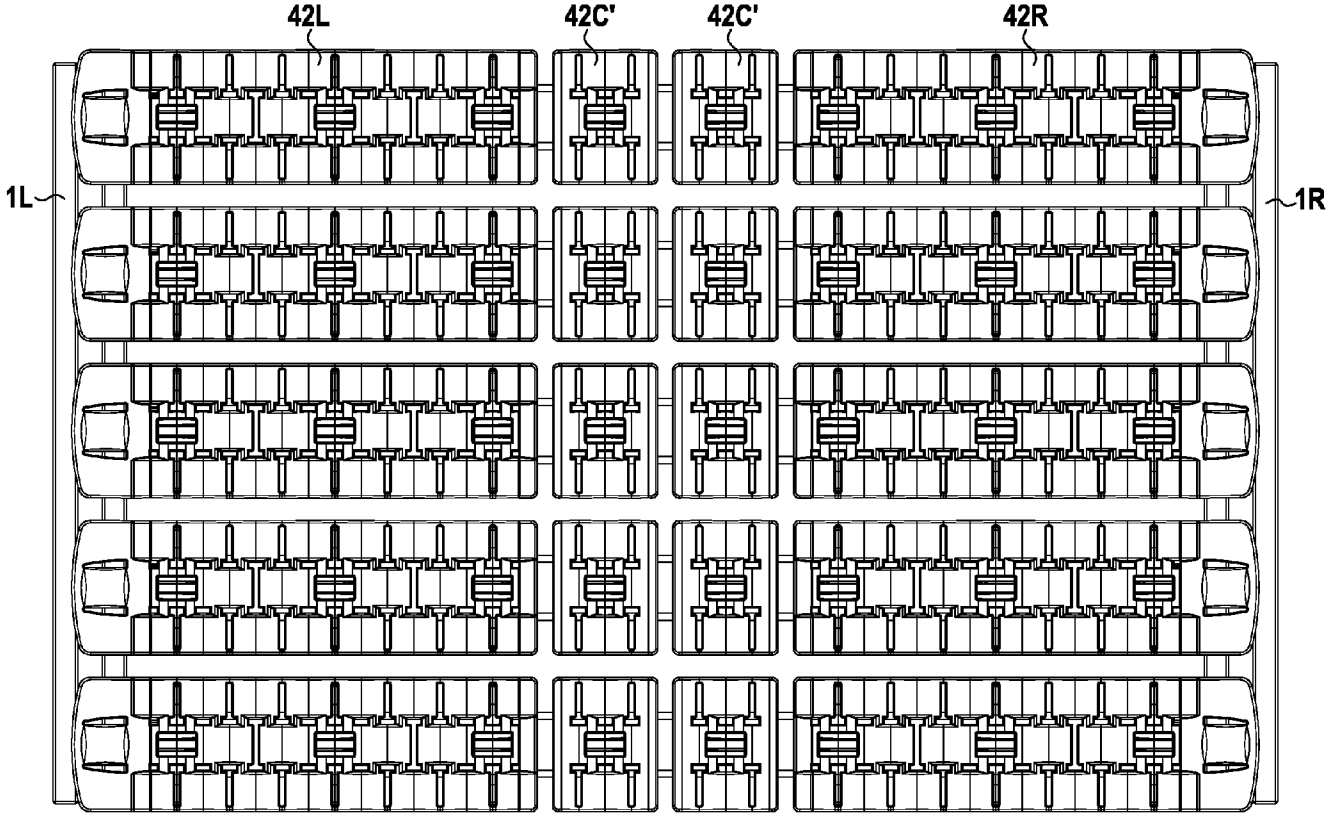
FIG. 12C is a view analogous to the FIG. 12A view, but showing a third variant embodiment of a device.
Figure 13A:
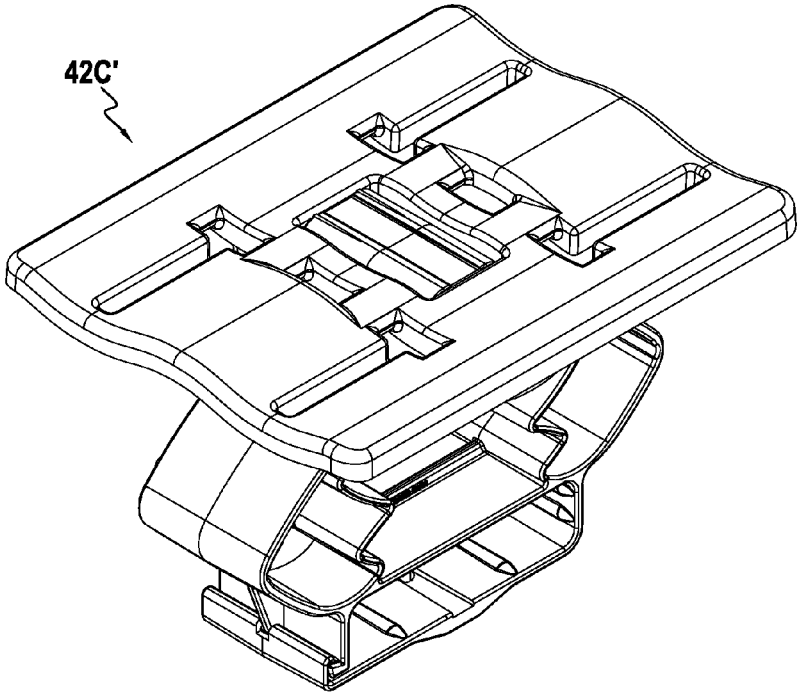
FIG. 13A shows a central platform segment, as assembled to a single resilient member, of the device shown in FIGS. 12A and 12C.
Figure 13B:
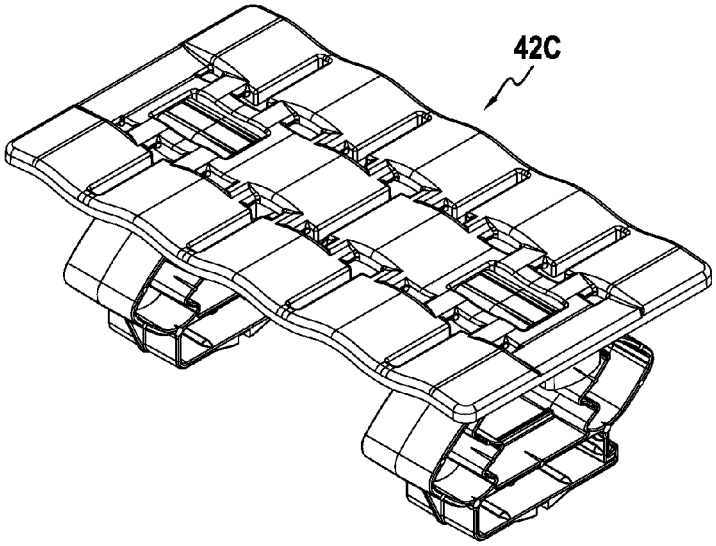
FIG. 13B shows a central platform segment, as assembled with two resilient members, of the device shown in FIG. 2.

Third Variant:

This third variant is identical to the embodiment described in detail above, except that the single central segment 42C of that embodiment is replaced with two smaller segments 42C', each of which is connected to a respective single resilient member (see, in particular, FIG. 12C and FIG. 13A).

Figure 14:
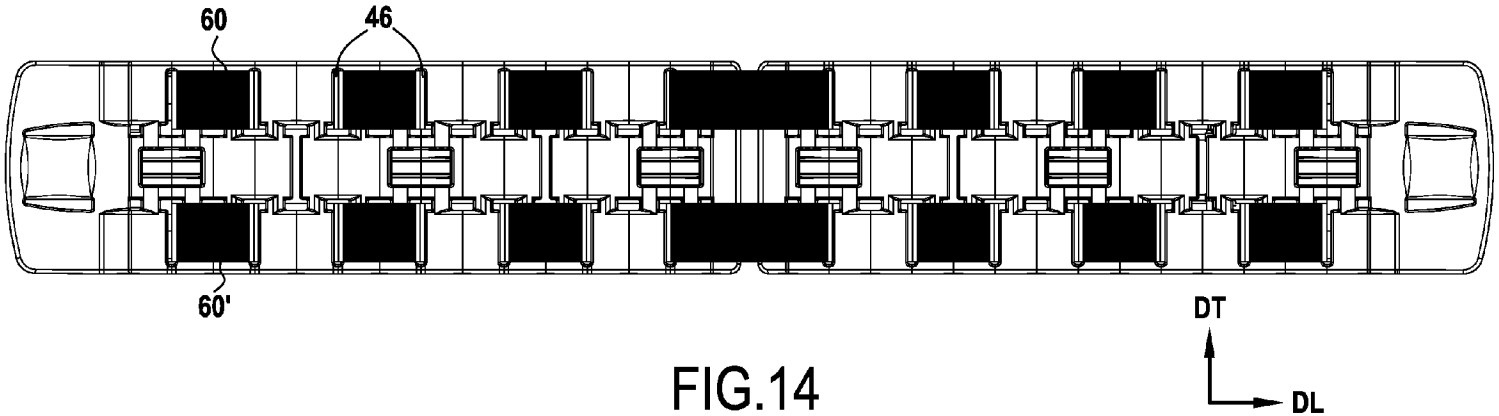
FIG. 14 is a plan view of a fourth variant embodiment of a device, provided with straps shown in a dark color to make the figure easier to understand.
Figure 15:
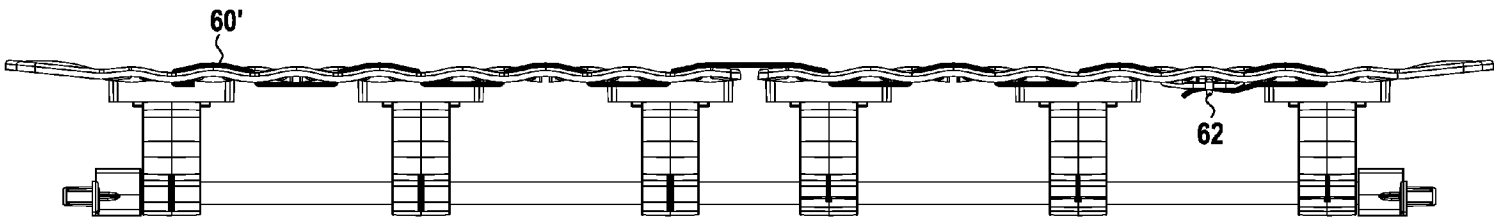
FIG. 15 is a view analogous to FIG. 14, but seen from the side, in a longitudinal plane of the device.
Figure 16:
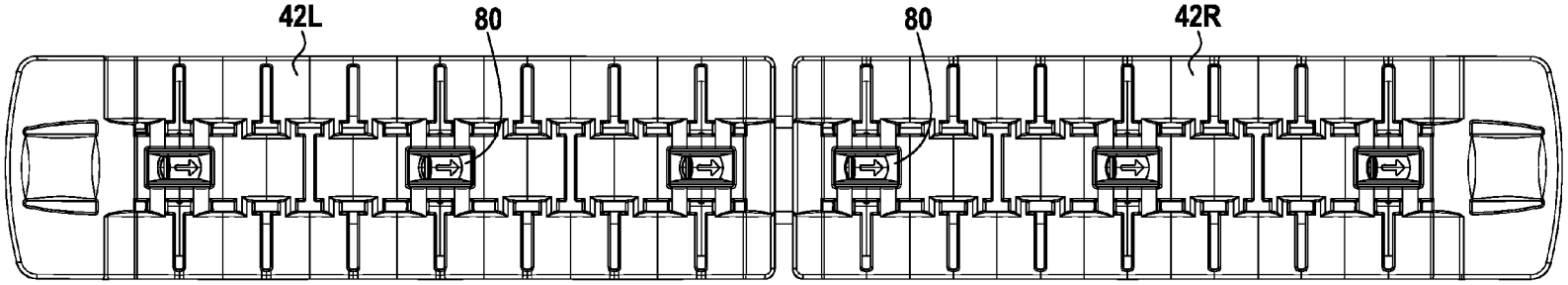
FIG. 16 is a plan view of a fifth variant embodiment of a device.

Fourth Variant:

In this variant, the device 10 is further provided with at least one strap (in particular with two straps 60 and 60' in this variant) passing through the recesses 46 in the platform 40 so as to project alternately below and above the platform (see, in particular FIGS. 14 and 15).

In this variant, each strap 60 and 60' is a attached to the platform 40 via a buckle 62, in a manner that is well known per se.

In addition, in this variant, each strap 60 and 60' projects alternately below and above the platform in the longitudinal direction DL.

In addition, in this variant, each strap 60 and 60' interconnects, in the longitudinal direction DL, the various segments of the platform, e.g. for improving the overall consistency of the platform and/or for improving the continuity of the support for the mattress in the longitudinal direction DL.

In addition, in this variant, the straps 60 and 60' are spaced apart from one another in the transverse direction DT.

Fifth Variant:

In this variant, at least one (and in particular every) resilient member is provided with a resilient body 80 mounted to move on said resilient member in order to allow the stiffness of said resilient member to be modified.

Such a configuration is well known per se. By way of non-limiting example, it is possible to implement one of the solutions described in the European Patent Application filed on 23 May 2012 under number 12169155.4 and published on 28 Nov. 2012 under number EP 2 526 835 A1. The contents of that European Patent Application are an integral part of the present specification and are not developed again in the present specification with concern for concision.

The embodiments and implementations described in the present specification are given by way of non-limiting illustration, it being easy for the person skilled in the art, on the basis of this specification, to modify the embodiments or implementations, or to consider others, without going beyond the scope of the invention.

In addition, the various characteristics of these embodiments or implementations may be used in isolation or in mutual combination. When they are combined, these characteristics may be combined as described above or differently, the invention not being limited to the specific combinations described in the present specification. In particular, unless otherwise specified, a characteristic described in relation to one embodiment or to one implementation may be applied in analogous manner to another embodiment or to another implementation.

The invention claimed is:

1. A support device designed to extend between two long sides of a bed base frame or of a seat base frame so as to support a mattress, wherein said support device comprises:

a lower section comprising an elongate crosspiece extending in a longitudinal direction between a first end for fastening to a first one of the two long sides and a second end for fastening to a second one of the two long sides, the longitudinal direction being a main direction of elongate extension of the elongate crosspiece, and the elongate crosspiece having a middle equidistant from the first end and the second end;

an upper section comprising a platform suitable for supporting the mattress; and an intermediate section resiliently interconnecting the lower section and the upper section via a plurality of resilient members that are disposed along the elongate crosspiece, wherein said plurality of resilient members comprises at least three first resilient members, each of which is disposed between the first end and the middle of the elongate crosspiece; and wherein a longitudinal spacing, in the longitudinal direction, between the two first resilient members that are closest to the first end is greater than a longitudinal spacing, in the longitudinal direction, between the two first resilient members that are closest to the middle of the elongate crosspiece.

2. A support device according to claim 1, wherein the longitudinal spacing, in the longitudinal direction, between the two first resilient members that are closest to the first end is at least 1.3 times greater than the longitudinal spacing, in the longitudinal direction, between the two first resilient members that are closest to the middle of the elongate crosspiece.

3. A support device according to claim 1, wherein the plurality of resilient members are made of a same material.

4. A support device according to claim 1, wherein the plurality of resilient members have identical shapes.

5. A support device according to claim 1, wherein at least one section from among the lower section, the intermediate section and the upper section of the support device has a plane of symmetry that is transverse relative to the longitudinal direction of the elongate crosspiece.

6. A support device according to claim 5, wherein the lower section, the intermediate section, and the upper section are all symmetrical about the plane of symmetry, and wherein the plane of symmetry contains the middle of the crosspiece.

7. A support device according to claim 1, wherein the platform is formed integrally in one piece.

8. A support device according to claim 1, wherein the platform is dissociated into a plurality of distinct segments along the longitudinal direction.

9. A support device according to claim 8, wherein a first one of said plurality of distinct segments interconnects, in the longitudinal direction, at least two resilient members from among said at least three first resilient members.

10. A support device according to claim 9, wherein the first one of said plurality of distinct segments interconnects, in the longitudinal direction, at least the two first resilient members that are closer to the first end.

11. A support device according to claim 10, wherein, relative to the two first resilient members to which the first one of said plurality of distinct segments is connected, said first one of said plurality of distinct segments projects in the longitudinal direction to a larger extent on the side closer to the first end of the elongate crosspiece than on the side closer to the middle of the elongate crosspiece.

12. A support device according to claim 8, wherein a second one of said plurality of distinct segments is connected to at least that one of the at least three resilient members that is the closest to the middle of the elongate crosspiece.

13. A support device according to claim 1, wherein the platform has at least one contact zone that is designed to come into contact with the mattress, and that has relief for minimizing the contact with the mattress.

14. A support device according to claim 13, wherein the relief includes at least one longitudinal succession of undulations along the longitudinal direction.

15. A support device according to claim 14, wherein the relief transversely includes a plurality of longitudinal successions of undulations that are offset in the longitudinal direction relative to one another.

16. A support device according to claim 15, wherein each of the plurality of longitudinal successions of undulations has the same spatial period and said plurality of longitudinal successions of undulations are offset, in the longitudinal direction, from one another by one half of said spatial period.

17. A support device according to claim 1, wherein the platform is provided with recesses forming thin zones in which the thickness of material is thinner and which allow the stiffness of the platform to be reduced locally.

18. A support device according to claim 17, wherein the platform includes a relief that includes at least one longitudinal succession of undulations along the longitudinal direction, and wherein the recesses are formed between the undulations in such a manner that the undulations are interconnected via the thin zones.

19. A support device according to claim 17, including at least one strap passing through the recesses so as to project alternately below and above the platform.

20. A support device according to claim 1, including at least one resilient body mounted to be mobile on at least one of the plurality of resilient members so as to allow the stiffness of said resilient member to be modified.

21. An assembly comprising:

a bed base frame or a seat base frame that is provided with two long sides; and a plurality of support devices, all of which extend between the two long sides in mutually parallel manner, in order to support a mattress, each of said support devices comprising a lower section comprising an elongate crosspiece extending in a longitudinal direction between a first end fastened to a first one of the two long sides and a second end fastened to a second one of the two long sides, the longitudinal direction being a main direction of elongate extension of the elongate crosspiece, and the elongate crosspiece having a middle equidistant from the first end and the second end;

an upper section comprising a platform suitable for supporting the mattress; and an intermediate section resiliently interconnecting the lower section and the upper section via a plurality of resilient members that are disposed along the elongate crosspiece, wherein said plurality of resilient members comprises at least three first resilient members, each of which is disposed between the first end and the middle of the crosspiece, and wherein a longitudinal spacing, in the longitudinal direction, between the two first resilient members that are closest to the first end is greater than a longitudinal spacing, in the longitudinal direction, between the two first resilient members that are closest to the middle of the elongate crosspiece.

22. A support device designed to extend between two long sides of a bed base frame or of a seat base frame so as to support a mattress, wherein said support device comprises:

a lower section comprising an elongate crosspiece extending in a longitudinal direction between a first end for fastening to a first one of the two long sides and a second end for fastening to a second one of the two long sides, the longitudinal direction being a main direction of elongate extension of the elongate crosspiece, and the elongate crosspiece having a middle equidistant from the first end and the second end;

an upper section comprising a platform suitable for supporting the mattress; and an intermediate section resiliently interconnecting the lower section and the upper section via a plurality of resilient members that are disposed along the crosspiece, wherein said plurality of resilient members comprises at least three first resilient members, each of which is disposed between the first end and the middle of the elongate crosspiece, wherein a longitudinal spacing, in the longitudinal direction, between the two first resilient members that are closest to the first end is greater than a longitudinal spacing, in the longitudinal direction, between the two first resilient members that are closest to the middle of the elongate crosspiece, wherein the platform is dissociated into a plurality of distinct segments along the longitudinal direction, and wherein a first one of said plurality of distinct segments interconnects, in the longitudinal direction, at least two resilient members from among said at least three first resilient members.

* * * * *